US009790668B2

(12) United States Patent
Lin et al.

(10) Patent No.: US 9,790,668 B2
(45) Date of Patent: Oct. 17, 2017

(54) COMBINED SHOWER WITH GRAVITY SWITCH MECHANISM

(71) Applicant: FUJIAN XIHE SANITARY WARE TECHNOLOGY CO., LTD., Nan'an, Fujian (CN)

(72) Inventors: Xiaofa Lin, Nan'an (CN); Xiaoshan Lin, Nan'an (JP); Qiqiao Liu, Nan'an (CN); Xiaoqing Deng, Nan'an (CN); Jun Xu, Nan'an (CN)

(73) Assignee: FUJIAN XIHE SANITARY WARE TECHNOLOGY CO., LTD., Nan'an (CN)

( * ) Notice: Subject to any disclaimer, the term of this patent is extended or adjusted under 35 U.S.C. 154(b) by 0 days.

(21) Appl. No.: 15/048,309

(22) Filed: Feb. 19, 2016

(65) Prior Publication Data

US 2016/0263597 A1 Sep. 15, 2016

(30) Foreign Application Priority Data

Mar. 13, 2015 (CN) ..... 2015 2 0144599 U

(51) Int. Cl.
*E03C 1/04* (2006.01)
*B05B 1/18* (2006.01)
*B05B 1/30* (2006.01)

(52) U.S. Cl.
CPC ..... *E03C 1/0408* (2013.01); *B05B 1/18* (2013.01); *B05B 1/30* (2013.01)

(58) Field of Classification Search
CPC ..... E03C 1/0408; B05B 1/18; B05B 1/30
USPC ..... 137/625.44, 625.45, 46, 883; 251/205–209; 239/447
See application file for complete search history.

(56) References Cited

U.S. PATENT DOCUMENTS 2,364,491 A * 12/1944 Triadou ..... E03D 9/085 239/530
8,162,004 B2 * 4/2012 Albert ..... F16K 11/0525 137/340
2005/0098661 A1 5/2005 Lev
2012/0325353 A1 * 12/2012 Zhou ..... B05B 1/1618 137/625
2015/0354192 A1 * 12/2015 Hauth ..... E03D 9/085 4/448

FOREIGN PATENT DOCUMENTS

CN 101862713 A 10/2010

* cited by examiner

*Primary Examiner* — Arthur O Hall
*Assistant Examiner* — Joel Zhou
(74) *Attorney, Agent, or Firm* — Rabin & Berdo, P.C.

(57) ABSTRACT

A combined shower with a gravity switch mechanism includes a wall-fixed shower, a handheld shower and a water diversion component, the water diversion component includes a water inlet, two water outlets respectively connected to the wall-fixed shower and handheld shower, and a switching component which is used to switch the waterway communication between the water inlet and two water outlets. The shower also includes a gravity switch mechanism and an attachment portion. The attachment portion interacts with the switching component to drive the activation of the switching component to trigger the switch to make the handheld shower activate or remain static relative to the position of the wall-fixed shower.

10 Claims, 9 Drawing Sheets

COMBINED SHOWER WITH GRAVITY SWITCH MECHANISM

FIELD OF THE INVENTION

The present invention relates to sanitary wares, especially to a combined shower with gravity switch mechanism.

BACKGROUND OF THE INVENTION

There are many showers existing in the market including multi-functional combined shower such as combining handheld shower with fixed show like sunflower shower, spray head on the wall or swing shower, the function of water diversion is accomplished by handling switches of each shower mechanically, normally it should be designed with two switches respectively to control water inlet and select water outlet from one of the showers, therefore the user should shift the switches manually before the action of taking handheld shower from the rack, so that it will make the using process complex cause occupying two hands or two steps; meanwhile, there are some defects existing in prior art of combined showers: firstly, it needs two parts to accomplish the switching function then result in more complicated design of manufacturing structure and high manufactory cost; secondly, it takes big space to install necessary components on the wall of bathroom like switches for water inlet and outlet controlling as well as racks for hanging handheld shower or sunflower shower; thirdly, it's inclined to be confused in the using process of identifying the waterway switched by which shower before several times of trial and error; therefore, as can be seen from above, presently it is difficult to satisfy the needs for effective manufacturing, convenient usage and space saving of the prior art of combined shower.

SUMMARY OF THE INVENTION

The object of the present invention is to overcome the technical problems of the existing technology, and the present invention provides a combined shower with gravity switch mechanism of simple structure and easy implement through the design of an attachment portion set on the handheld shower to be served as the gravity switch mechanism, so that it will accomplish function of switching only through the action of taking off the handheld shower or putting it away, is will make the control clear and simple for users during the operation.

The technical proposal of the present invention is as below:

A combined shower with gravity switch mechanism, comprising a wall-fixed shower, a handheld shower and a water diversion component, the water diversion component includes a water inlet, two water outlets respectively connected to said wall-fixed shower and handheld shower, and a movable switching component which is used to switch the waterway communication between said water inlet and two water outlets; wherein further comprises a gravity switch mechanism which includes a attachment portion where to make the handheld shower attach activating itself or staying static relative to position of the wall-fixed shower depending on sensing force came from the gravity of the handheld shower applied or not, the attachment portion is also cooperated to the switching component to drive the activation of the switching component to trigger switch.

In another preferred embodiment, wherein when the handheld shower attaches to the attachment portion, said water inlet is connected to one of the water outlet which is connected to the wall-fixed shower; when the handheld shower is detached from the attachment portion, said water inlet is connected to the other water outlet which is connected to the handheld shower.

In another preferred embodiment, wherein said gravity switch mechanism further comprises an elastic part which can preserve energy when the handheld shower attaches to the attachment portion, whereas release the preserved energy to urge the attachment portion reset to its original position when the handheld shower is detached from the attachment portion.

In another preferred embodiment, wherein said elastic part is coupled between the wall-fixed shower and the attachment portion.

In another preferred embodiment, wherein said switching component which is in transmission connection to the attachment portion can rotate in relative to the position of said wall-fixed shower.

In another preferred embodiment, wherein the attachment portion is in rotational connection to the wall-fixed shower.

In another preferred embodiment, wherein the attachment portion comprises a connection part connected the wall-fixed shower and a pivotal part located on both sides of the connection portion, the pivotal parts provide pivoted joint between the connection part and the switching component, the attachment portion also includes a shower rack which can embrace the attachment of the handheld shower.

In another preferred embodiment, wherein the gravity switch mechanism comprises a pivot base which can make coaxial and synchronous rotation with the switching component by a flange set on the eccentric position of the pivot base, the flange is cooperated with a concave slot set on said pivotal part; rotation of said pivot base is driven by the jigging motion of said attachment portion when the handheld shower is attached on or detached from the attachment portion, the rotation of said pivot base drives the switching component to trigger switch.

In another preferred embodiment, wherein the switching component comprises a plug end and a rotation end, said rotation end rotates in relative to the position of said wall-fixed shower, the plug end can selectively block one of said water outlets with the rotation of said rotation end, the rotation end is in transmission connection to said pivot base.

In another preferred embodiment, wherein a positioning convex shaft set on said switching component is cooperated to a positioning groove set on said pivot base. In another preferred embodiment, wherein the water diversion component comprises an upper sleeve and a lower sleeve which are connected to each other to form a cavity to permit fluid communication between said water inlet and water outlet; said switching component is located in said cavity and switchable set on mounting holes of said upper sleeve and lower sleeve with sealing to selectively block one of said water outlets.

In another preferred embodiment, wherein the water diversion component further comprises a leather cap and a spring, said spring has one end placed in the leather cap and the other end abutting against said switching component; the leather cap is in synchronous motion with the switch component to block one of said water outlets. In another preferred embodiment, wherein further comprises torsion springs disposed at both sides of the gravity switch mechanism to help the gravity switch mechanism return to its original position.

In another preferred embodiment, wherein said torsion spring comprises a rolling part and extending parts which are extending out from both ends of said rolling part; the gravity switch mechanism is provided with a bulge and a embed groove on each sidewall to respectively cooperate with said rolling part and extending part of the torsion spring.

Comparing to the existing known technology, the technical proposal of the present invention has advantages as follows:

The combined shower with gravity switch mechanism of the present invention with simple structure and it is easy for implement, cause the sensing force of the attachment portion is changeable pending on the gravity of handheld shower applied or not, which will be identified by the user's action of taking off the handheld shower or hang it back, the attachment portion will be activated by its sensing force then drive the switching components work to trigger switch, it will make the switch function accomplished easily and clearly cause the handheld shower is taken as the controlling key element; The present invention achieves the function of controlling the diversion of waterway by the handheld shower's own gravity applied or not to trigger switch, on one hand, it's easy to operate and with high stability to take the handheld shower's own gravity as the switch key element, then it will avoid strength taking on hard pressing to trigger switch; on the other hand, it is easy to control and step-saving for switch test cause the result of water outlet will be consistent with the user's using intention either for wall-fixed shower or handheld shower, it's not necessary to waste time to recognize the water outlet come from which shower by controlling certain switch.

DETAILED DESCRIPTION OF THE EMBODIMENTS

The present invention will be further described with the drawings and the embodiments to make the present invention more clear and well-known. It should be noted that, the embodiments of the present invention is used to describe the present invention but not to limit the scope of the present invention.

Figure 1:
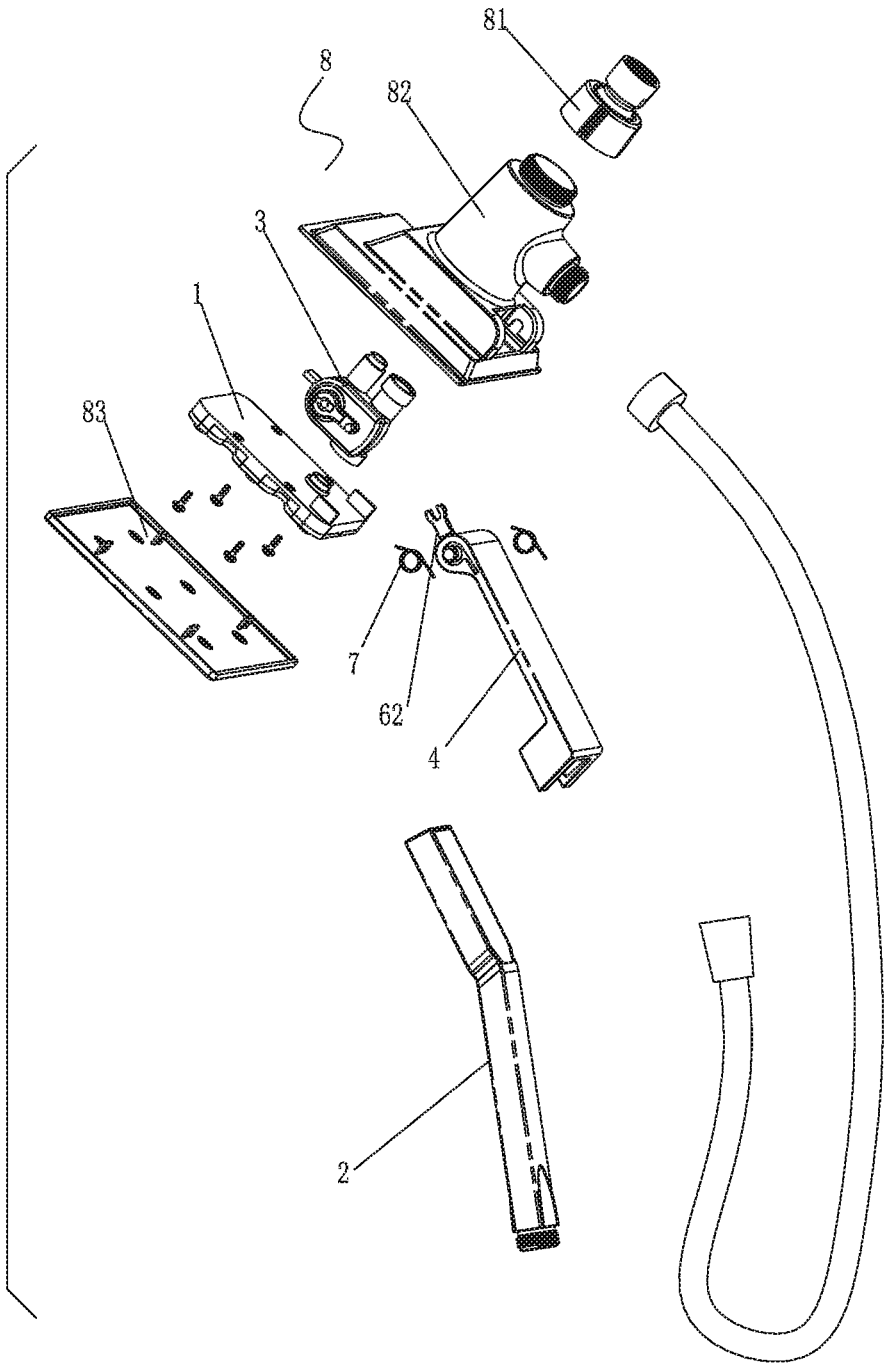
FIG. 1 illustrates an exploded and schematic diagram of the combined shower of the present invention.
Figure 2:
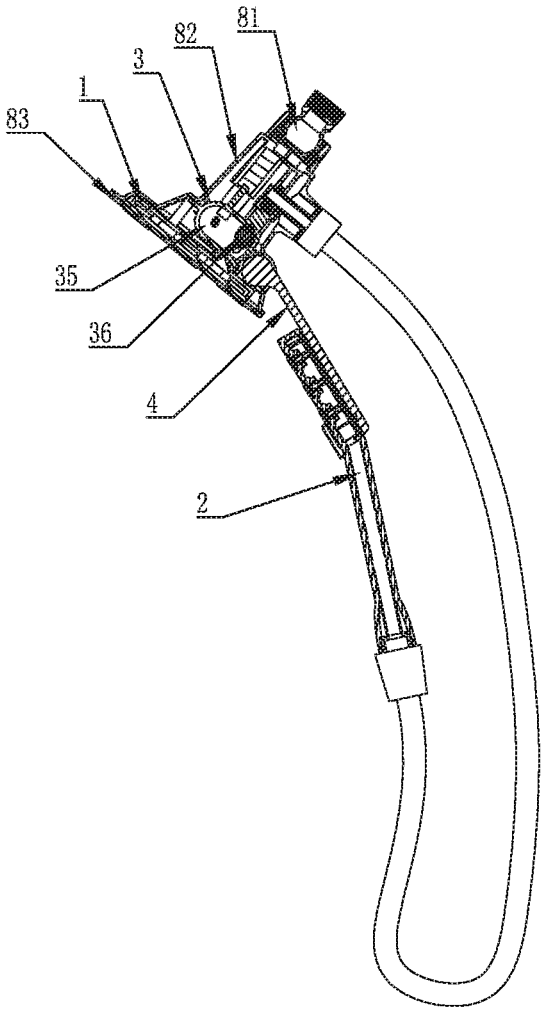
FIG. 2 illustrates a schematic and sectional diagram of the combined shower of the present invention.
Figure 3:
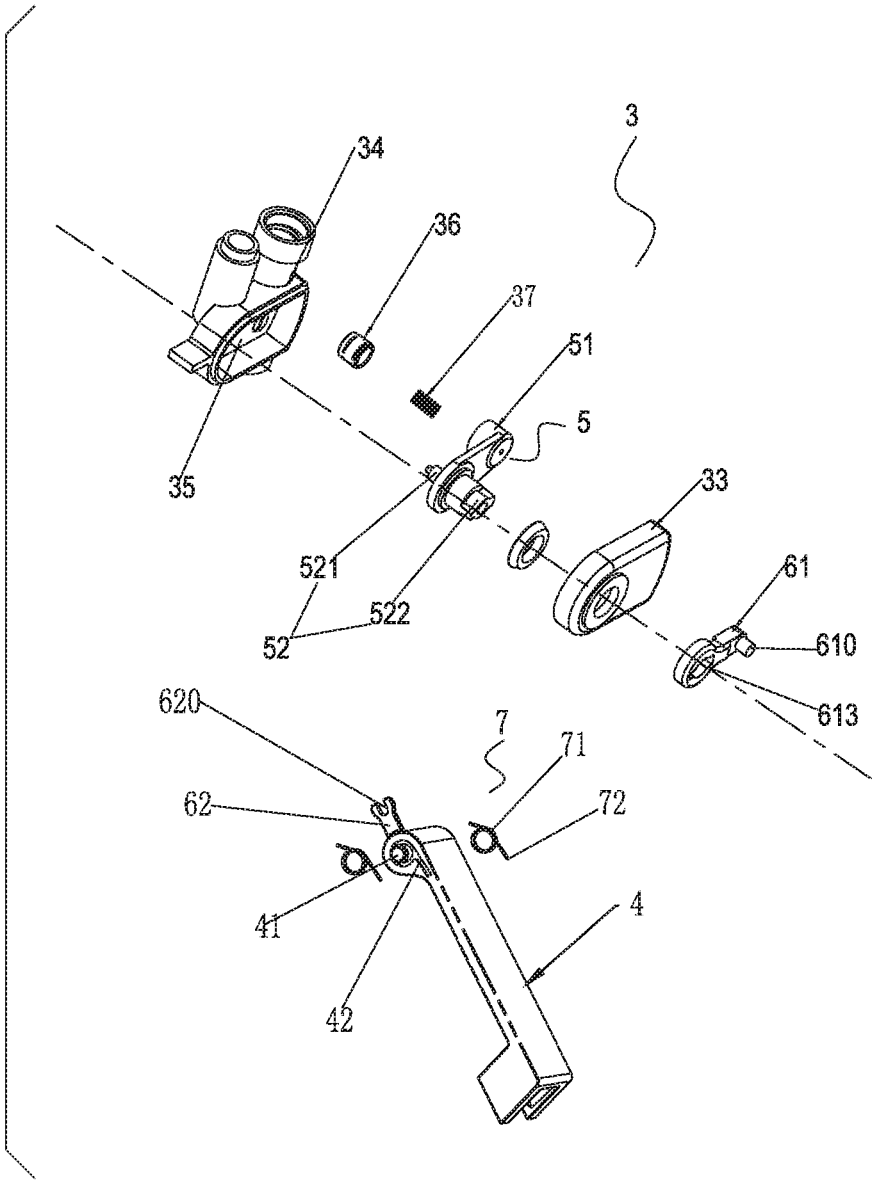
FIG. 3 illustrates an exploded and schematic diagram of the water diversion component and the connecting structure of the present invention.

As figured in FIGS. 1~3, a combined shower with gravity switch mechanism of the present invention comprises a wall-fixed shower 1, a handheld shower, a water diversion component 3 and a gravity switch mechanism 4 which is cooperated to the water diversion component 3.

The water diversion component 3 comprises a water inlet 30 and two water outlets 31/32 that are respectively connected to the wall-fixed shower 1 and the handheld shower; the water diversion component 3 comprises an upper sleeve 33, a lower sleeve 34 and a switching component, the switching component comprises a switching shaft 5. The upper sleeve 33 and the lower sleeve 34 which are connected to each other to form a cavity 35 to permit fluid communication between water inlet 30 and water outlet 31/32, the switch shaft 5 is located in cavity 35 and switchable set on mounting holes of upper sleeve 33 and lower sleeve 34 with sealing to selectively block one of water outlets 31/32. Preferred, the water diversion component 3 further comprises a leather cap 36 and a spring 37, spring 37 has one end placed in the leather cap 36 and the other end abutting against switching shaft 5; therein, the leather cap 36 is in synchronous motion with the switching shaft 5 to block one of water outlets 31/32. In this embodiment, the waterways are switched in rotation way, but not limited to this, as needed, in sliding way, or button control, or in movable connection component method can also be used to trigger waterway diversion switch.

The gravity switch mechanism 4 is cooperated with the handheld shower 2. The gravity switch mechanism 4 comprises an attachment portion where to make the handheld shower 2 attach, the attachment portion comprises a connection part connected the wall-fixed shower 1 and a pivotal part 62 located on both sides of the connection portion, the pivotal parts 62 provide pivoted joint between the connection part and the switching component, the attachment portion also includes a shower rack 4 which can embrace the attachment of the handheld shower 2. The pivotal parts 62 can be designed in connecting rod which is set on the connection part, the shower rack 4 can be a handling rack. The attachment portion can activate itself or staying static relative to position of the wall-fixed shower 1 depending on sensing force came from the gravity of the handheld shower 2 applied or not, the attachment portion is also cooperated to the switching component to drive the activation of the switching component to trigger switch.

In detailed, the gravity switch mechanism comprises a pivot base 61 which is coupled with switching shaft 5 then make coaxial and synchronous rotation with the switching shaft 5 by a flange 610 set on the eccentric position of the pivot base 61, the flange 610 is cooperated with a concave slot 620 set on the pivotal part 62, the pivot base 61 and pivotal part 62 form connecting structure 6. The sensing force of the attachment portion is changeable pending on the handheld shower 2 being attached on or detached from the attachment portion, and the changeable force will make the attachment portion swing between the first place and the second place then activate pivot base 61 to rotate, the rotation of pivot base 61 will urge rotation of switching shaft 5 then make one of water outlet 31/32 inside cavity 35 be blocked consequently. rotation of said pivot base is driven by the jigging motion of said attachment portion when the handheld shower is attached on or detached from the attachment portion, the rotation of said pivot base drives the switching component to trigger switch. In this embodiment, the changeable force make the attachment portion swing then activate the switching component, but not limited to this, as needed, also can make the attachment portion in sliding way to drive the switching component work, or even also can fix the attachment portion and the switching component together as well.

In detailed, the switching shaft 5 comprises a plug end 51 and a rotation end 52, the plug end 51 is connected with leather cap 36, the cooperated part making between rotation end 52 and lower sleeve 34 is formed as rotation shaft 521, with certain section of which going through upper sleeve 33 to make connection with the pivot base 61 and perform synchronous movement with it; a positioning convex shaft 522 set on switching component to connect pivot base 61, on which setting a positioning groove 613 to cooperate to positioning convex shaft 522.

In detailed, also includes an elastic part such as torsion spring 7 disposed at both sides of the gravity switch mechanism 4; torsion spring 7 comprises a rolling part 71 and extending parts 72 which are extending out from both ends of rolling part 71; the gravity switch mechanism 4 is provided with a bulge 41 and a embed groove 42 on each sidewall to respectively cooperate with rolling part 71 and extending part 72. The elastic part can preserve energy when the handheld shower 2 attaches to the attachment portion, whereas release the preserved energy to urge the attachment portion reset to its original position when the handheld shower 2 is detached from the attachment portion.

In the detailed embodiment, as figured in FIGS. 1~3, the combined shower with gravity switch mechanism of the present invention comprises a main body 8, a water diversion component 3 and a connecting structure 6;

The main body 8 comprises a wall-fixed shower 1 and a handheld shower 2; the wall-fixed shower 1 takes rain showerhead for example, firstly connect the ball head 81 with the main body 82, then assemble water diversion component 3 in the main body 82, connect sunflower shower 1 with the lower water outlet 32 of the water diversion component 3, which is assembled below the main body 82, the top cover 83 covers on the sunflower shower 1, then assemble the gravity switch mechanism 4 on the main body 82 with one end connecting to the water diversion component 3; Meanwhile one end of the flexible pipe is connected to the upper water outlet 31 of the water diversion component 3, while the other end is connected to the handling portion of the handheld shower 2;

The water diversion component 3 comprises a water inlet 30 and two water outlets 31, 32 respectively connected to the sunflower shower 1 and the handheld shower 2; the water diversion component 3 comprises an upper sleeve 33, a lower sleeve 34, a switching shaft 5, a leather cap 36 and a spring 37; The upper sleeve 33 and lower sleeve 34 are connected to each other to form a cavity 35 to permit fluid communication between water inlet 30 and water outlet 31/32; the switching shaft 5 is located in cavity 35 and switchable set on mounting holes of upper sleeve 33 and lower sleeve 34 with sealing to selectively block one of water outlets 31/32; spring 37 is coupled in leather cap 36 then fixed on the plug end 51 of the switching shaft 5, then assemble V-shape sealing ring on the rotation end 52 of the switching shaft 5, rotation end 52 goes through the upper sleeve 33 to make connection to the pivot base 61 of connecting structure 6, pivot base 61 will take switching shaft 5 rotate together when the pivot base 61 is activated by external force, in the condition of which, leather cap 36 will block one of water outlet 31/32 of lower sleeve 34 to make the water go into handheld shower 2 or sunflower shower 1.

The connecting structure 6 comprises a pivot base 61, a connecting rod 62 and a torsion spring 7 for repositioning; one end of pivot base 61 is coupled with the switching shaft 5, while the other end extends a flange 610 by the side of pivot base 61; the connecting rod 62 is a extending part extended from one end of the gravity switch mechanism 4, and the connecting rod 62 is disposed with a concave slot 620 which is designed to cooperate to the flange 610; therein, the motion of gravity switch mechanism 4 activates pivot base 61 to rotate through connecting rod 62 then urge switching shaft 5 to rotate at the same time, then drive leather cap 36 to perform relative rotation to the switching shaft 5 in result of blocking one of the water outlet 31/32 in the cavity 35. The torsion spring 7 are disposed at both sides of the gravity switch mechanism 4; the gravity switch mechanism 4 is provided with a bulge 41 and a embed groove 42 on each sidewall to respectively cooperate with rolling part 71 and extending part 72 of torsion spring 7; the pivot base 61 makes rotation as the swing motion of the gravity switch mechanism 4, meanwhile, urging the torsion spring 7 distorted in the embed groove 42.

Figure 4:
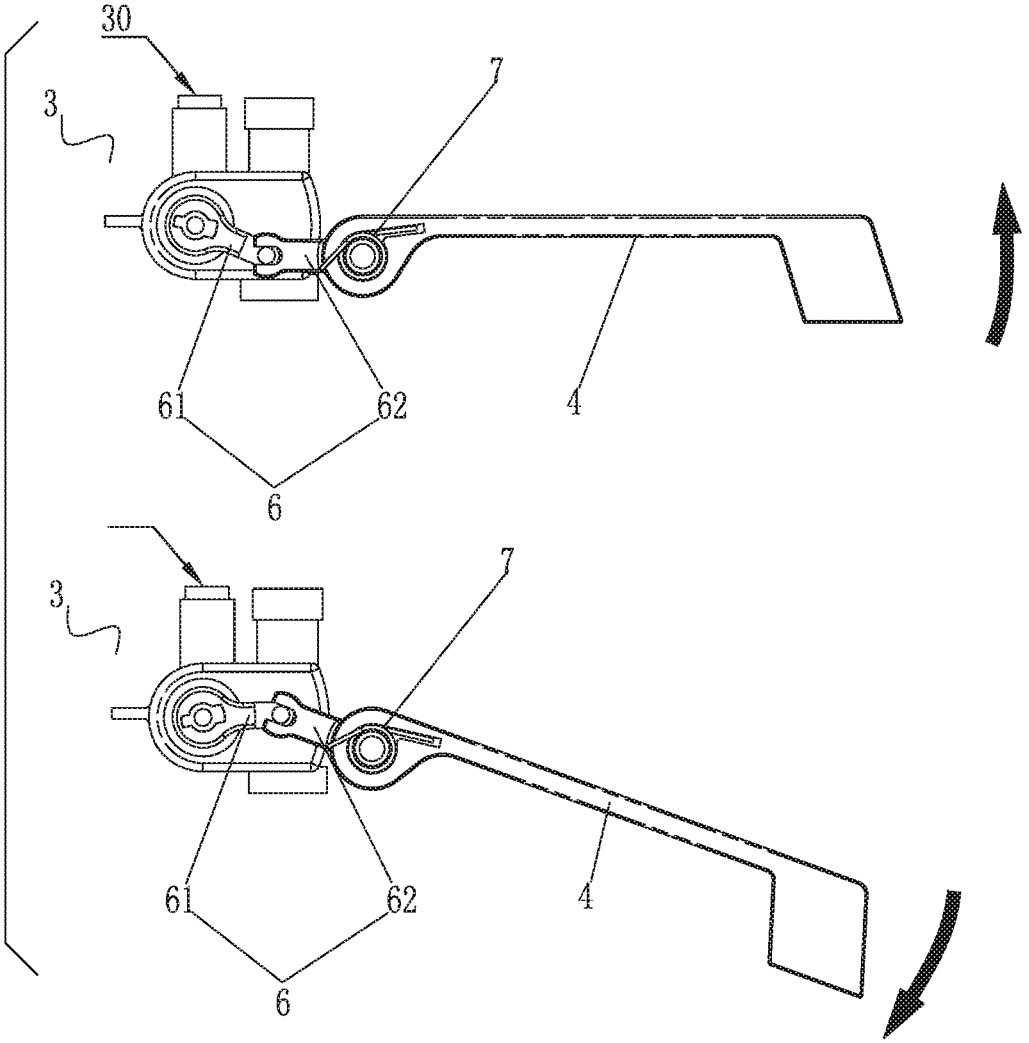
FIG. 4 illustrates a first schematic diagram of the water diversion component and the connecting structure of the present invention.
Figure 5:
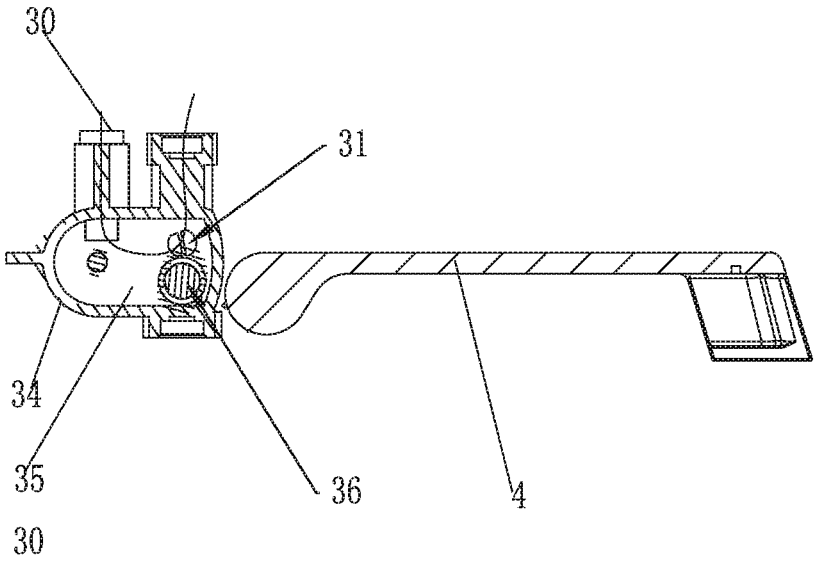
FIG. 5 illustrates a first sectional diagram of the water diversion component and the connecting structure of the present invention.
Figure 6:
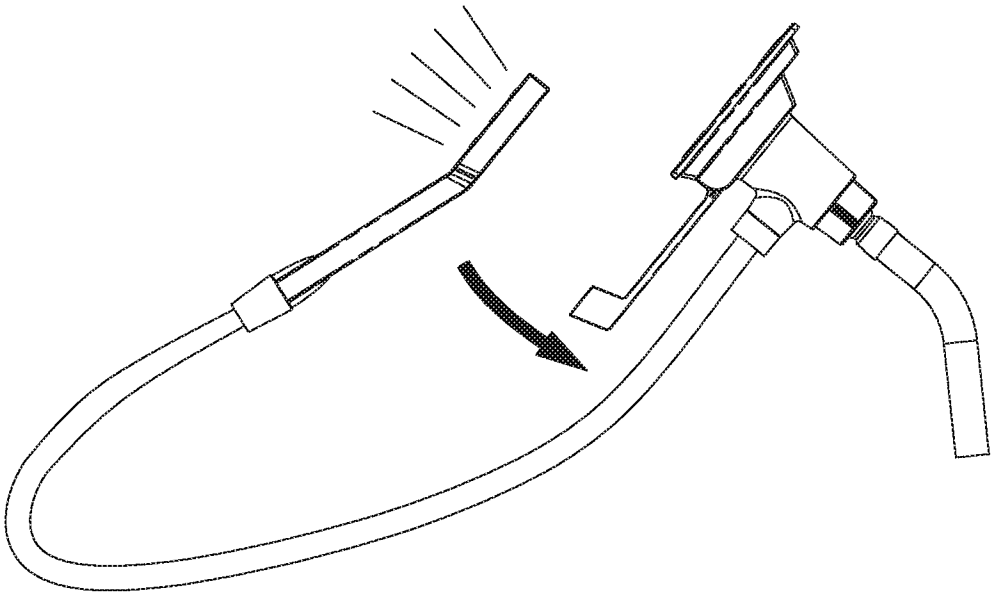
FIG. 6 illustrates a schematic diagram of the wall-fixed shower of the present invention when water flows out of the wall-fixed shower.
Figure 7:
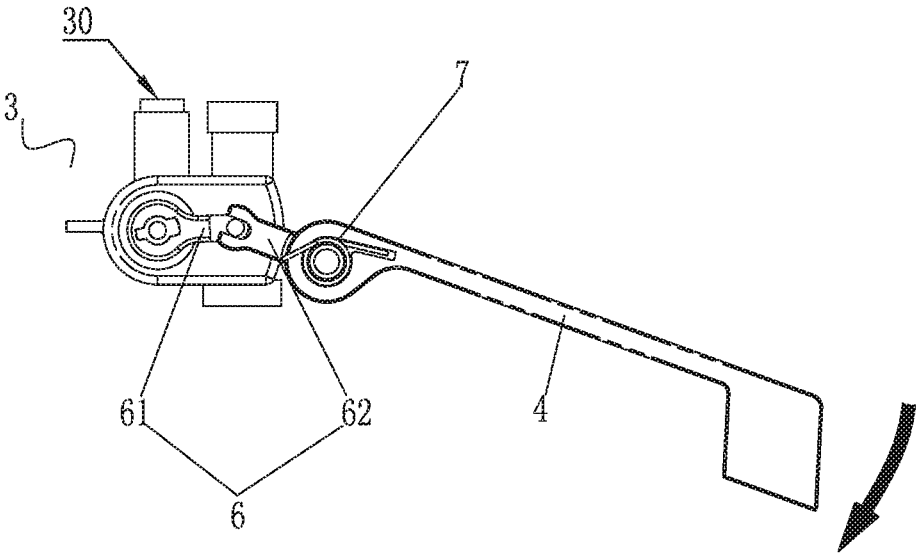
FIG. 7 illustrates a second schematic diagram of the water diversion component and the connecting structure of the present invention.
Figure 8:
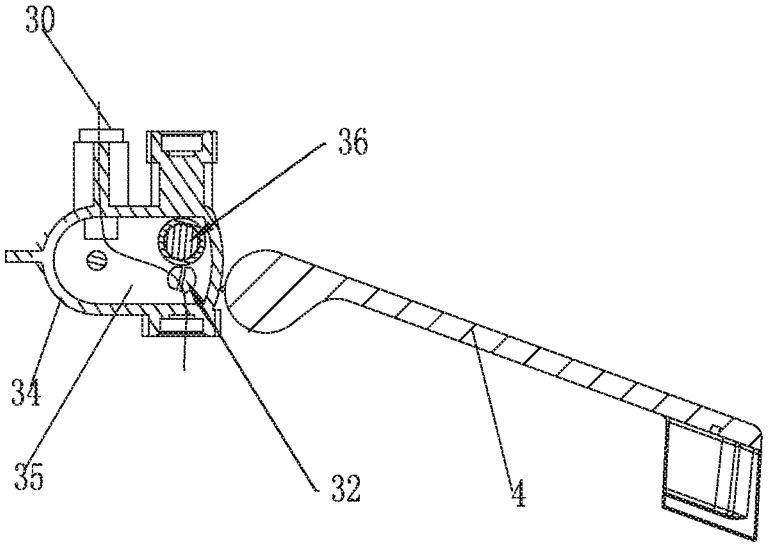
FIG. 8 illustrates a second sectional diagram of the water diversion component and the connecting structure of the present invention.
Figure 9:
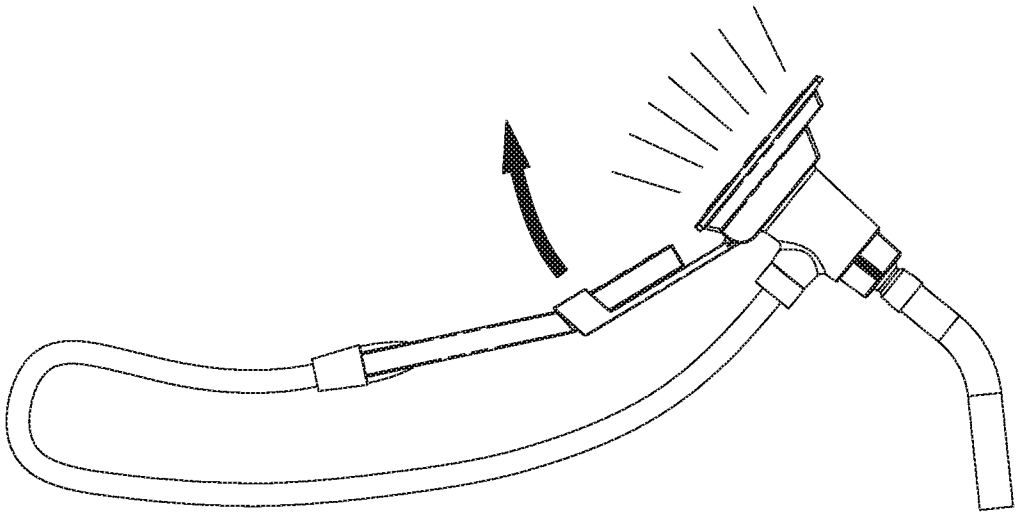
FIG. 9 illustrates a schematic diagram of the handheld shower of the present invention when water flows out of the handheld shower.

The working process of the present invention is that: in normal condition, the handheld shower 2 is attached to the shower rack then water flows out of the sunflower shower 1; as figured in FIGS. 4~6, due to installing of the torsion springs 7 cooperated to the protrudings 41 and side grooves 42 at both sides of the shower rack 4, when the handheld shower 2 is detached from the shower rack 4, the torsion springs 7 will urge the shower rack 4 bounce to the highest position, then driving the connecting rod 62 set at the front side of the shower rack 4 promote the pivot base 61 to rotate downwardly around the center of the rotation end 52 of the switching shaft 5, and drives the switching shaft 5 rotates correspondingly, the leather cap 36 installed on the plug end 51 of the switching shaft 5 would rotate to block the lower water outlet 32, then water will go through the upper water outlet 31 of the lower sleeve 34, then flows to the handheld shower 2 through the flexible pipe, in the consequence, the handheld shower 2 outflows water but not the sunflower shower 1; As figured in FIGS. 7~9, when the handheld shower 2 is attached to the shower rack 4, as the total gravity of the handheld shower 2 with the flexible pipe is larger than the elastic force applying on the torsion springs 7 which is disposed at the protrudings 41 of the shower rack 4, so the shower rack 4 would swing downwardly to the lowest position; at this time, the connecting rod 62 installed at the front end of the shower rack 4 would urge the pivot base 61 to rotate upwardly around the center of the rotation end 52 of the switching shaft 5, and drive the switching shaft 5 rotates correspondingly, the leather cap 36 installed on the plug end 51 of the switching shaft 5 would rotate to block the upper water outlet 31, then water will go through the lower water outlet 32 of the lower sleeve 34, then flows to the sunflower shower 1, in consequence, the sunflower shower 1 outflows water but not the handheld shower 2.

The combined shower with gravity switch mechanism of the present invention with simple structure and it is easy for implement, by the way of taking the attachment portion as the gravity switch mechanism and making the handheld shower's own gravity as the switch key element, it's easy and clear to make the switch function accomplished. The present invention accomplish the technical effect of controlling the water diversion between handheld shower and wall-fixed shower automatically through the gravity switch mechanism to instead of manual switch control in prior art, the waterway will switch to the wall-fixed shower when the handheld shower is attached to the shower rack, but switch to the handheld shower automatically when the handheld shower is detached from the shower rack, this water diversion structure achieves the function of controlling the diversion of waterway by the handheld shower's own gravity applied or not, it's easy to control without the need of operating control switch additionally, and also it's step-saving for switch test to recognize the water outlet come from which shower by controlling certain switch.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A combined shower with gravity switch mechanism, comprising a wall-fixed shower, a handheld shower and a water diversion component, the water diversion component includes a water inlet, two water outlets connected to said wall-fixed shower and handheld shower respectively, and a movable switching component which is used to switch the waterway communication between said water inlet and two water outlets; further comprising a gravity switch mechanism which includes an attachment portion where to make the handheld shower attach activating itself or stay static relative to a position of the wall-fixed shower depending on sensing force coming from the gravity of the handheld shower being applied or not, wherein the attachment portion also cooperates with the switching component to drive the activation of the switching component to trigger a switch, wherein said switching component which is in transmission connection to the attachment portion can rotate in relative to the position of said wall-fixed shower, the attachment portion is in rotational connection to the wall-fixed shower, the attachment portion comprises a connection part connected the wall-fixed shower and a pivotal part located on both sides of the connection portion, the pivotal part provides a pivoted joint between the connection part and the switching component, the attachment portion also includes a shower rack which can embrace the attachment of the handheld shower, the gravity switch mechanism comprises a pivot base which can make coaxial and synchronous rotation with the switching component by a flange set on the eccentric position of the pivot base, the flange cooperating with a concave slot set on said pivotal part; rotation of said pivot base is driven by jigging motion of said attachment portion when the handheld shower is attached to or detached from the attachment portion, the rotation of said pivot base driving the switching component to trigger the switch.

2. The combined shower with gravity switch mechanism according to claim 1, wherein when the handheld shower attaches to the attachment portion, said water inlet is connected to one of the water outlet which is connected to the wall-fixed shower;

when the handheld shower is detached from the attachment portion, said water inlet is connected to the other water outlet which is connected to the handheld shower.

3. The combined shower with gravity switch mechanism according to claim 1, wherein said gravity switch mechanism further comprises an elastic part which can preserve energy when the handheld shower attaches to the attachment portion, whereas release the preserved energy to urge the attachment portion reset to its original position when the handheld shower is detached from the attachment portion.

4. The combined shower with gravity switch mechanism according to claim 3, wherein said elastic part is coupled between the wall-fixed shower and the attachment portion.

5. The combined shower with gravity switch mechanism according to claim 1, wherein the switching component comprises a plug end and a rotation end, said rotation end rotates in relative to the position of said wall-fixed shower, the plug end can selectively block one of said water outlets with the rotation of said rotation end, the rotation end is in transmission connection to said pivot base.

6. The combined shower with gravity switch mechanism according to claim 1, wherein a positioning convex shaft set on said switching component is cooperated to a positioning groove set on said pivot base.

7. The combined shower with gravity switch mechanism according to claim 1, wherein the water diversion component comprises an upper sleeve and a lower sleeve which are connected to each other to form a cavity to permit fluid communication between said water inlet and water outlet;

said switching component is located in said cavity and switchable set on mounting holes of said upper sleeve and lower sleeve with sealing to selectively block one of said water outlets.

8. The combined shower with gravity switch mechanism according to claim 7, wherein the water diversion component further comprises a leather cap and a spring, said spring has one end placed in the leather cap and the other end abutting against said switching component;

the leather cap is in synchronous motion with the switch component to block one of said water outlets.

9. The combined shower with gravity switch mechanism according to claim 4, wherein further comprises torsion springs disposed at both sides of the gravity switch mechanism to help the gravity switch mechanism return to its original position.

10. The combined shower with gravity switch mechanism according to claim 9, wherein said torsion spring comprises a rolling part and extending parts which are extending out from both ends of said rolling part;

the gravity switch mechanism is provided with a bulge and a embed groove on each sidewall to respectively cooperate with said rolling part and extending part of the torsion spring.

* * * * *